United States Patent [19]

Stulga et al.

[11] Patent Number: 4,731,117

[45] Date of Patent: Mar. 15, 1988

[54] NICKEL-BASE POWDER METALLURGY ALLOY

[75] Inventors: John E. Stulga, Homestead; Frank J. Rizzo, McMurray, both of Pa.

[73] Assignee: Crucible Materials Corporation, Pittsburgh, Pa.

[21] Appl. No.: 926,541

[22] Filed: Nov. 4, 1986

[51] Int. Cl.[4] ..... C22C 19/05

[52] U.S. Cl. ..... 75/243; 75/244; 75/246

[58] Field of Search ..... 75/230, 243, 245, 246, 75/950, 244; 148/312, 410, 428; 420/445

[56] References Cited

U.S. PATENT DOCUMENTS

| | | | |
|---|---|---|---|
| 3,046,108 | 7/1962 | Eiselstein | 420/445 |
| 3,649,256 | 3/1972 | Fletcher | 75/243 |
| 3,681,061 | 8/1972 | Fletcher | 75/243 |
| 3,926,568 | 12/1975 | Benjamin et al. | 75/230 |
| 4,118,223 | 10/1978 | Acuncius et al. | 420/443 |
| 4,460,542 | 7/1984 | Herchenroeder | 420/443 |

FOREIGN PATENT DOCUMENTS

| | | | |
|---|---|---|---|
| 146982 | 8/1949 | Australia | 420/445 |
| 57-47842 | 3/1982 | Japan | 420/445 |

OTHER PUBLICATIONS

Herchenroeder et al., "A New, Wrought, Heat Resistant Ni-Cr-Al-Fe-Y Alloy", *Journal of Metals*, Nov. 1983, pp. 16-22.

Weaver, "Powder Metallurgy and the Aerogas Turbine Engine, *Powder Metallurgy*, 1984, vol. 27, No. 3, pp. 135-140.

*Primary Examiner*—John F. Terapane

*Assistant Examiner*—Eric Jorgensen

*Attorney, Agent, or Firm*—Finnegan, Henderson, Farabow, Garrett & Dunner

[57] ABSTRACT

An age-hardenable, corrosion-resistant, nickel-base fully dense article of compacted prealloyed particles. The article has a fine, uniformly distributed gamma-prime phase for strength and hardness. The alloy consists essentially of, in weight percent, carbon 0.05 max, chromium 15 to 25, molybdenum 6.5 to 10, columbuium 4 to 6.5, iron 9 max, aluminum 0.2 to 0.8, nitrogen 0.05 max, titanium, 0.6 max, and balance nickel. The alloy article has an absence of interstitial phases at prior particle boundaries and may be age-hardened to a minimum room-temperature 0.2% offset yield strength of 120,000 psi.

6 Claims, No Drawings

NICKEL-BASE POWDER METALLURGY ALLOY

BACKGROUND OF THE INVENTION

In applications such as valves, valve components and tubular products for use in oil extraction applications, it is necessary to have an alloy characterized by a combination of high strength and corrosion resistance. More specifically, the alloy must have corrosion resistance in the presence of corrosive media such as sodium chloride, hydrogen sulfide and carbon dioxide.

Nickel-base alloys heretofor used in these applications are disclosed in U.S. Pat. Nos. 3,165,000 and 3,046,108. Although the nickel-base alloys of these patents have useful combinations of mechanical properties and corrosion resistance, they are deficient in that neither of these properties in combination is sufficient for the above mentioned oil-extraction applications. In addition to having a combination of high strength and corrosion resistance, the alloy must also be characterized by fabricability so that it may be fabricated to the desired component configurations, such as valves, valve components and tubular shapes. The necessary strength in alloys having sufficient corrosion resistance may be obtained with the conventional alloy designed as UNS-NO6625 by cold working. This alloy, however, is difficult to fabricate and specifically cracking is encountered during fabrication. Age-hardenable alloys, such as UNS-NO7718, which may be heat treated to the required strength levels, do not have sufficient corrosion resistance for the more severe corrosion environments encountered in oil extraction applications.

OBJECTS OF THE INVENTION

It is accordingly a primary object of the present invention to provide an alloy characterized by a good combination of strength and corrosion resistance but which may be readily fabricated to the desired shapes and thereafter age-hardened to achieve the desired combination of hardness and corrosion resistance.

A more specific object of the invention is to provide an alloy of this type that is produced from prealloyed particles compacted to achieve a fully dense article with the article having a gamma-prime strengthening phase uniformly and finely distributed throughout the article, which provide high strength.

Another more specific object of the invention is to provide a nickel-base alloy article of this type wherein good corrosion resistance to environments with corrosive media including sodium chloride, hydrogen sulfide and carbon dioxide is achieved in combination with high strength and fabricability for the desired product configurations.

SUMMARY OF THE INVENTION

Accordingly, the present invention provides an age-hardenable, corrosion-resistant, nickel-base fully dense article of compacted prealloy particles. The article has a fine, uniformly distributed gamma-prime phase which provides the desired strength. In addition, the gamma-prime phase is achieved by an aging heat treatment. This enables the article to achieve a minimum room-temperature 0.2% offset yield strength of 120,000 psi. By properly balancing the alloy composition, and particularly titanium and the interstitial elements, primarily nitrogen, an absence of interstitial phases at prior particle boundaries may be achieved. This enhanced the fabricability of the alloy.

The nickel-base alloy article in accordance with the invention comprises prealloyed particles within the composition limits set forth in Table I.

TABLE I (percent by weight)

| | Broad Range | Preferred Range 1 | Preferred Range 2 | Preferred Range 3 |
|---|---|---|---|---|
| Carbon | .05 max. | .03 max. | .03 max. | .03 max. |
| Chromium | 15–25 | 20–23 | 20–23 | 20–23 |
| Molybdenum | 6.5–10 | 6.5–10 | 6.5–10 | 6.5–10 |
| Columbium | 4–6.5 | 4.5–5.5 | 4.5–5.5 | 4.5–5.5 |
| Iron | 9 max. | 9 max. | 9 max. | 9 max. |
| Aluminum | .2–.8 | .4–.8 | .4–.6 | .4–.6 |
| Nitrogen | .05 max | .03 max | .007–.03 | .007 max. |
| Titanium | .6 max. | .6 max. | .1 max. | .1–.6 |
| Nickel | balance | balance | balance | balance |

With the nickel-base alloy article in accordance with the invention, it is critical that the alloy article be produced by powder metallurgy techniques. These may include any of the conventional techniques suitable to achieve compacting of prealloyed particles of the nickel-base alloy composition as set forth in Table I to achieve full density. By using powder metallurgy and specifically prealloyed particles of the nickel base alloy composition, it is possible to obtain a high content of a hardening phase necessary for the desired strength, while having the hardening phase in a fine, uniform distribution or dispersion within the article. It is desireable that the hardening phase be present as a fine, uniform dispersion throughout the article to avoid fabricability problems and promote resistance to cracking. If the article were produced by conventional casting techniques, this would result in an article having gross microstructural segregation due to the slow cooling rate inherent in conventional casting. This segregation would result in an undesirable size and distribution of the hardening constitutents, which as discussed above promotes cracking and tearing during fabrication to the desired changes. Because of the lack of chemical or microstructural segregation inherent in proper powder metallurgy processing, the article in accordance with the invention is characterized by a uniform microstructure and mechanical properties throughout the cross-section of the article. Since the gamma-prime phase for hardening and strengthening is produced by an aging heat treatment, this can be obtained after fabrication of the article which further enhances fabrication, because the article may be fabricated prior to this hardening treatment. By the use of powder metallurgy techniques the article may, if desired, be compacted to or near the desired final shape of the article. This results in lower fabrication costs with respect to fabrication operations which may include forging and machining. Where forming techniques, which may include hot rolling and forging, are required the microstructural homogeneity of the article in accordance with the invention resulting from the use of powder metallurgy processing facilitates these forming operations.

The hardening phase or dispersion achieved during the aging heat treatment is an intermetallic phase of nickel, columbium, aluminium and titanium. It is necessary, therefore, that these elements be within the composition limits in accordance with the invention to provide the nickel-base alloy of the article with this desired gamma-prime hardening phase to achieve strengthening upon aging heat treatment. Although titanium contributes to the formation of the gamma-prime hardening phase, it is necessary that it be controlled in relation to the nitrogen content to avoid the formation of interstitial phases, such as titanium nitrides, carbides and carbonitrides, at prior particle boundaries after compacting of the prealloyed particles to form the desired article. Specifically, in this regard, titanium and nitrogen must be maintained within the limits set forth in Table I for preferred ranges 2 and 3. Titanium should be decreased in the presence of increased nitrogen and vice versa. It is necessary to control titanium and nitrogen so that there is not sufficient amounts of both of these elements in combination to form the undesirable interstitial phase, which will be present at prior particle boundaries. The presence of these phase at prior particle boundaries reduces the ductility and fabricability of the nickel-base alloy article and may also adversely affect corrosion resistance thereof.

The prealloyed particles for use in the manufacture of the alloy article in accordance with the invention may be produced by conventional inert gas atomizing of a melt of the alloy composition. Specifically, with these conventional practices, a charge of the desired composition is melted in an inert environment. The molten metal is atomized to form powder by impingement of an inert gas against a stream of the molten metal. The molten metal is thereby atomized and rapidly cooled, typically in an atmosphere preventing oxidation thereof. The powder, which is of a spherical shape, is then compacted to form the desired article by techniques such as hot isostatic pressing in an autoclave or by extrusion. The typical particle size suitable for use in the practice of the invention does not exceed −10 mesh (US Standard) and generally will not exceed −30 mesh.

DETAILED DESCRIPTION OF THE INVENTION AND SPECIFIC EXAMPLES

To demonstrate the invention, six nickel-base alloys were prepared of the compositions set forth in Table II.

TABLE II

| | Experimental Alloy Compositions (percentage by weight) | | | | | |
|---|---|---|---|---|---|---|
| Element | Alloy A (517-352) | Alloy B (516-878) | Alloy C (516-985) | Alloy D (517-353) | Alloy E (516-879) | Alloy F (516-881) |
| Carbon | .02 | .018 | .027 | .02 | .015 | .041 |
| Chromium | 20.5 | 21.1 | 21.2 | 20.3 | 20.95 | 20.41 |
| Molybdenum | 8.49 | 6.67 | 8.69 | 8.73 | 6.75 | 6.67 |
| Columbium | 5.0 | 5.0 | 4.0 | 4.36 | 5.02 | 4.89 |
| Iron | 4.79 | 8.48 | 2.53 | .11 | 7.86 | 8.51 |
| Aluminum | .50 | .49 | .38 | .32 | .48 | .51 |
| Titanium | — | — | — | .18 | .44 | .43 |
| Nitrogen | .015 | .017 | .003 | .006 | .017 | .003 |
| Nickel | balance | balance | balance | balance | balance | balance |
| Manganese | .03 | .15 | .17 | .03 | .15 | .10 |
| Silicon | .14 | .11 | .23 | .11 | .11 | .12 |

Prealloyed powders from each of the alloys of the composition set forth in Table II were produced by gas atomization. The powders were collected and screened to a nomianl −30 mesh size and loaded into mild steel containers. These containers were evacuated after loading of the powder to remove any moisture present therein and after evacuation the containers were sealed by pressure welding. The evacuated, powder-filled containers were heated to a temperature of 2050° F. and subjected to hot isostatic compacting at a nominal pressure of 15,000 psi. This resulted in compacted articles of each of the alloys set forth in Table II being consolidated to a density of essentially 100% of theoretical.

Each of the articles were then sectioned, heat treated, machined to form tensile specimens and tested at room temperature. The heat treatment for each of the alloy articles consisted of age hardening preceeded in some cases by annealing. The specific heat treatment conditions for each of the compacts is set forth in Table III.

TABLE III

| | Tensile Properties of Alloys A,B,C,D,E,F | | | | |
|---|---|---|---|---|---|
| Alloy | Heat Treatment | UTS (ksi) | YS (ksi) | % E | % RA |
| A | 1325° F./8 hrs/FC 100° F./hr to 1150° F./8 hrs/AC | 181 | 136 | 25 | 29 |
| B | Mill Anneal + 1325° F./8 hrs/FC 100° F./hr to 1150° F./8 hrs/AC | 181 | 133 | 29 | 37 |
| C | 1575° F. 1 hr/WQ + 1250° F./8 hrs/AC | 125 | 54 | 63 | 63 |
| D | 1325° F./8 hrs/FC 100° F./hr to 1150° F./8 hrs/AC | 172 | 114 | 37 | 40 |
| E | Mill Anneal + 1325° F./8 hrs/FC 100° F./hr to 1150° F./8 hrs/AC | 189 | 148 | 9.5 | 10.5 |
| F | 1325° F./8 hrs/FC 100° F./hr to 1150° F./8 hrs/AC | 190 | 144 | 18 | 20 |

UTS — ultimate tensile strength
YS — yield strength
E — elongation
RA — reduction in area As may be seem from Table III, the compacts of Alloys A and B, in accordance with the invention, are capable of achieving, in the heat treated condition 120 ksi minimum yield strength while maintaining good ductility. This results from having sufficient columbium and aluminum present with nickel to form the desired gamma-prime hardening phase for strengthening while maintaining a proper balance of titanium and nitrogen to obviate the formation of interstitial phases at prior particle boundaries which impair the ductility. Alloy C does not have sufficient columbium, aluminum and titanium in combination with nickel to achieve age-hardening. Likewise, Alloy D, which exhibits some age hardening, does not achieve the desired age-hardening minimum of 0.2% offset yield strength of 120,000 psi at room-temperature. Again this results from columbium, aluminum and titanium in combination being too low to achieve the formation of sufficient gamma-prime hardening phase during aging treatment to achieve the desired strengthening effect. With Alloy E, the combination of titanium and nitrogen is too high to avoid the formation of titanium carbonitrides at prior particle boundaries, and the formation thereof with respect to this compact results in poor ductility, as demonstrated by the elongation and reduction in area data set forth in Table III with respect to this compact. With Alloy F, although the titanium is at a level substantially equivalent to the titanium level of the compact of Alloy E by maintaining nitrogen at a low level of 0.003% an improvement in ductility is achieved over the compact of Alloy E. It may be seen, therefore, that by comparing the compacts of Alloy E and F the effect of controlling the relative amounts of titanium and nitrogen present in the alloy of the compact for purposes of improved ductility is demonstrated.

As may be seen from the data presented in Table III, for purposes of the invention it is necessary to control columbium and aluminum so that they are present in sufficient amounts to combine with nickel to form the desired gamma-prime hardening phase for strengthening upon again heat treatment. Titanium also contributes to the formation of this gamma-prime phase but must be controlled in relation to the nitrogen present to avoid the formation of interstitial compounds, namely titanium carbonitrides, at prior particles boundaries to degrade the ductility of the article.

What is claimed is:

1. An age-hardenable, corrosion-resistant, nickel-base fully dense article of compacted prealloyed particles, said article having a fine, uniformly distributed gamma prime phase and comprising an alloy consisting essentially of, in weight percent,

| | |
|---|---|
| carbon | .05 max. |
| chromium | 15–25 |
| molybdenum | 6.5–10 |
| columbium | 4–6.5 |
| iron | 9 max. |
| aluminum | .2–.8 |
| nitrogen | .05 max. |
| titanium | .6 max |
| nickel | balance. |

2. The alloy article of claim 1 with said alloy consisting essentially of, in weight percent,

| | |
|---|---|
| carbon | .03 max. |
| chromium | 20–23 |
| molybdenum | 6.5–10 |
| columbium | 4.5–5.5 |
| iron | 9 max. |
| aluminum | .4–.8 |
| nitrogen | .03 max. |
| titanium | .6 max |
| nickel | balance. |

3. The alloy article of claim 1 with said alloy consisting essentially of, in weight percent,

| | |
|---|---|
| carbon | .03 max. |
| chromium | 20–23 |
| molybdenum | 6.5–10 |
| columbium | 4.5–5.5 |
| iron | 9 max. |
| aluminum | .4–.6 |
| nitrogen | .007–.03 |
| titanium | .1 max |
| nickel | balance. |

4. The alloy article of claim 1 with said alloy consisting essentially of, in weight percent,

| | |
|---|---|
| carbon | .03 max. |
| chromium | 20–23 |
| molybdenum | 6.5–10 |
| columbium | 4.5–5.5 |
| iron | 9 max. |
| aluminum | .4–.6 |
| nitrogen | .007 max. |
| titanium | .1–.6 |
| nickel | balance. |

5. The alloy article of claim 1, or 2, or 3, or 4 being age-hardenable to a minimum room-temperature 0.2% offset yield strength of 120,000 psi.

6. The alloy article of claim 5 characterized by the absence of interstitial phases at prior particle boundaries.

* * * * *